US005890608A

United States Patent [19]

Hanes

[11] Patent Number: 5,890,608

[45] Date of Patent: Apr. 6, 1999

[54] DRAWBAR ASSEMBLY DRAFT LOAD BEARING INSERT

[75] Inventor: Douglas M. Hanes, Pittsburgh, Pa.

[73] Assignee: McConway & Torley Corporation, Pittsburgh, Pa.

[21] Appl. No.: 201,673

[22] Filed: Feb. 25, 1994

[51] Int. Cl.[6] ..... B61G 7/00; B61G 9/20

[52] U.S. Cl. ..... 213/75 R

[58] Field of Search ..... 213/50, 61, 62 R, 213/62 A, 69, 75 A

[56] References Cited

U.S. PATENT DOCUMENTS

| | | | |
|---|---|---|---|
| 1,557,060 | 10/1925 | Kadel | 213/67 A |
| 2,241,353 | 5/1941 | Kinne et al. | 213/72 |
| 3,709,376 | 1/1973 | Altherr | 213/62 R |
| 4,531,648 | 7/1985 | Paton | 213/50 |
| 4,555,033 | 11/1985 | Miller | 213/51 |
| 4,700,854 | 10/1987 | Chadwick | 213/62 R |
| 4,946,052 | 8/1990 | Kaim et al. | 213/35 R |
| 5,000,330 | 3/1991 | Kaim et al. | 213/62 R |
| 5,035,338 | 7/1991 | Kaufhold et al. | 213/50 |
| 5,096,075 | 3/1992 | Glover | 213/61 |

*Primary Examiner*—S. Joseph Morano
*Attorney, Agent, or Firm*—James Ray & Associates

[57] ABSTRACT

A specially configured insert used in a drawbar support housing. The insert is essentially a block member having at least a portion of an aperture extending therethrough from a front face to a back face. A concave draft load bearing surface is formed in the front face of the block member adjacent such aperture. A tapered surface area is formed adjacent such aperture which extends from the back face of the block member inwardly towards the concave draft load bearing surface to enable requisite movement of a shank portion of a drawbar.

16 Claims, 6 Drawing Sheets

DRAWBAR ASSEMBLY DRAFT LOAD BEARING INSERT

CROSS REFERENCE TO RELATED APPLICATION

The invention claimed in this application is closely related to an application by the same inventor and assigned to the same assignee titled "AN IMPROVED SUPPORT HOUSING FOR A ROTARY END OF A SLACKLESS DRAWBAR" having Ser. No. 08/201,672 and filed concurrently herewith, now U.S. Pat. No. 5,526,294.

FIELD OF THE INVENTION

The present invention relates, in general, to housing support members for retaining rotary drawbar assemblies in the end of a railway car center sill and, more particularly, the present invention relates to a replaceable draft load bearing insert member for use in a housing support member for the rotary end of a drawbar assembly.

BACKGROUND OF THE INVENTION

Prior to the present invention, slackless rotary drawbar assemblies have been in wide spread use in the railroad industry for a number of years to couple one end of a railway car to an adjacent end of another car.

One such housing support member for a slackless rotary drawbar assembly is taught in U.S. Pat. No. 4,966,291 which is assigned to the assignee of the present invention. The disclosure of this patent is incorporated herein by reference thereto. With the arrangement taught in this prior art reference free and cushioned slack is eliminated from the inner connection between cars. This slack elimination substantially minimizes undesirable longitudinal train action forces as well as the undesirable run in and run out of slack between adjacent cars during reversal of buff and draft train actions. This arrangement further minimizes the generation of large forces due to relative acceleration between the cars thereby reducing detrimental wear and damage to car components and lading. Obviously, reduction of wear and damage to such car components results in reduced maintenance cost and the reduction in damage to lading results in fewer damage claims which must be paid by the rail carrier.

Furthermore, the use of slackless rotary drawbar assemblies as a railcar coupling means has reduced the car weight by approximately 650 pounds. Such reduced car weight is achieved through elimination of the need for standard couplers, yokes, cushioning devices and striker bars. Such reduction in the weight of these cars translates into lower fuel consumption and, therefore, lower operating costs. Additionally the elimination of various car components further reduces the maintenance cost associated with these components.

However, the draft load bearing surfaces of the housing support members of these prior art devices have, to the best of applicants' knowledge, always been formed as an integral part of the housing support member. This design results in the entire housing support member being manufactured from relatively expensive material in order to provide adequate wear resistance. Further, when these wear surfaces have been worn sufficiently it requires replacement of the entire housing support member, thus resulting in higher maintenance and equipment cost.

Another prior art housing support assembly for a slackless rotary drawbar assembly is taught in U.S. Pat. No. 5,000,330, the disclosure of which is also incorporated herein by reference thereto.

Even though the housing support assembly in this rotary drawbar assembly includes both a separate front portion and back portion it suffers from the same wear problems as the housing support member taught in U.S. Pat. No. 4,966,291 discussed in detail above.

SUMMARY OF THE INVENTION

In a first embodiment, the present invention teaches a specially configured insert. This insert is used in a housing support member for the rotary end of a drawbar forming a part of a drawbar assembly. In essence, the insert forms a replaceable draft block member. This specially configured insert includes a generally rectangular block member. Such block member having each of a predetermined width, a predetermined height, a predetermined thickness, a front face portion, a back face portion, an upper face portion, a bottom face portion and a pair of side face portions. The insert further includes at least a portion of an aperture which extends through the block member from the front face portion to the back face portion. A concave draft load bearing surface is formed in the front face portion around such at least a portion of the aperture. Such concave draft load bearing surface is positioned for mating engagement with at least a portion of a convex surface area formed on a portion of the rotary end of a drawbar forming a part of a drawbar assembly. Such convex surface area on the rotary end of the drawbar applies draft loads to the concave draft load bearing surface of the insert. A tapered surface area is provided adjacent such at least a portion of the aperture to enable movement of the shank portion of the drawbar in both a vertical angling direction and a horizontal angling direction. This tapered surface area extends downwardly from the back face portion of the block member and inwardly toward the concave draft load bearing surface. A first edge portion of the block member adjacent the upper face portion and the back face portion and which extends between the pair of side face portions has a first predetermined configuration. A second edge portion disposed adjacent a first side face portion of such pair of side face portions and such back face portion and which extends between the upper face portion and the bottom face portion has a second predetermined configuration. Likewise, a third edge portion disposed adjacent a second side face portion of such pair of side face portions and such back face portion and which extends between the upper face portion and the bottom face portion has a third predetermined configuration.

The present invention further teaches an alternative embodiment for a specially configured insert used in an upper and lower front body portion of a housing support member for the rotary end of a drawbar which forms a portion of a drawbar assembly. In this embodiment the specially configured insert includes a first block member and a second block member. Such first block member has a predetermined configuration, a predetermined thickness, a front face portion, a back face portion and a bottom face portion. There is at least a first portion of an aperture disposed adjacent the bottom face portion of such first block member. This first portion of the aperture extends through the first block member from such front face portion to the back face portion. A first concave draft load bearing surface is formed in the front face portion around the first portion of such aperture. The first concave draft load bearing surface matingly engages with at least a first portion of a convex surface area formed on a portion of the rotary end of a drawbar forming a part of the drawbar assembly. Such convex surface area being disposed in a position to apply draft loads to the insert. The first block member has a first tapered surface area disposed adjacent such first portion of the aperture. The first tapered surface area extends downwardly from the back face portion of such first block member and inwardly toward the first concave draft load bearing surface to enable movement of the shank portion of such drawbar in both a vertical angling direction and a horizontal angling direction. Similar to the first block member, such second block member includes a predetermined configuration, a predetermined thickness, a front face portion, a back face portion and an upper face portion which engages with bottom face portion of such first block member. Disposed adjacent the upper face portion and extending through the second block member from the front face portion to the back face portion is at least a second portion of such aperture. A second concave draft load bearing surface is formed in the front face portion of the second block member around such second portion of the aperture. The second concave draft load bearing surface also engages a second portion of the convex surface area formed on such portion of the rotary end of such drawbar. The second portion of such convex surface area is also positioned to apply draft loads to such insert. The second block member also has a second tapered surface area located adjacent such second portion of the aperture. This second tapered surface area extends downwardly from the back face portion of such second block member and inwardly toward the second concave draft load bearing surface to enable movement of the shank portion of the drawbar in both the vertical angling direction and a horizontal angling direction.

According to a final embodiment of the present invention, there is taught a specially configured insert which includes a first generally rectangular block member having each of a predetermined width, a predetermined height, a predetermined thickness, a front face portion, a back face portion, an upper face portion, a bottom face portion and a pair of side face portions. At least a first portion of an aperture is formed through the first block member extending from the front face portion to the back face portion adjacent the bottom face portion thereof. A first concave draft load bearing surface is formed in the front face portion around such first portion of the aperture. The draft load bearing surface is matingly engageable with at least a first portion of a convex surface are formed on a portion of the rotary end of a drawbar forming a part of a drawbar assembly. The convex surface area being positioned to apply draft loads to the insert. There is a first tapered surface area disposed adjacent such first portion of the aperture which extends inwardly toward the aperture and downwardly from the back face portion of such first block member toward the first concave draft load bearing surface. This tapered surface area enables movement of a shank portion of the drawbar in each of a vertical angling direction and a horizontal angling direction. A first edge portion, having a first predetermined configuration, is disposed adjacent the upper face portion and the back face portion of such first block member. This first edge portion extends between the pair of side face portions. A second edge portion is disposed adjacent a first side face portion one of such pair of side face portions and such back face portion. This second edge portion extends between the upper face portion and the bottom face portion and has a second predetermined configuration. A third edge portion, having a third predetermined configuration, is disposed adjacent a second side face portion of such pair of side face portions and such back face portion. This third edge portion extends between the upper face portion and the bottom face portion. In this alternative embodiment, the insert also includes a second generally rectangular block member having each of a predetermined width, a predetermined height, a predetermined thickness, a front face portion, a back face portion, an upper face portion engageable with the bottom face portion of such first block member, a bottom face portion and a pair of side face portions. At least a second portion of such aperture is formed through the second block member and extends from such front face portion to the back face portion. The second portion of such aperture is disposed adjacent the upper face portion and an inner side face portion of the second block member. A second concave draft load bearing surface is formed in the front face portion of such second block member around the second portion of such aperture. The second draft load bearing surface is matingly engageable with at least a second portion of such convex surface area formed on such portion of the rotary end of the drawbar. Such second portion of the convex surface area being positioned to apply draft loading to the insert. A second tapered surface area is disposed adjacent the second portion of such aperture in the second block member. Such second tapered surface area extends inwardly toward the aperture and downwardly from the back face portion of the second block member toward the second concave draft load bearing surface to enable movement of the shank portion of the drawbar in both a vertical angling direction and a horizontal angling direction. A fourth edge portion is disposed adjacent the back face portion and an outer side face portion of the second block member. Such fourth edge portion extending between the upper face portion and bottom face portion of such second block member. A final essential element of this embodiment of the insert is, a third generally rectangular block member having each of a predetermined width, a predetermined height, a predetermined thickness, a front face portion, an upper face portion engageable with the bottom face portion of the first block member, a bottom face portion and a pair of side face portions. At least a third portion of such aperture is formed through the third block member and extends from the front face portion to the back face portion. The third portion of such aperture is disposed adjacent the upper face portion and an inner side face portion of the third block member. A third concave draft load bearing surface is formed in the front face portion of such third block member and the third portion of such aperture for mating engagement with at least a third portion of such convex surface area formed on the rotary end of a drawbar forming part of the drawbar assembly. Such third portion of the convex surface area is positioned to apply draft loads to the insert. There is a third tapered surface area located adjacent such third portion of the aperture in the third block member. This third tapered surface area extends inwardly toward the aperture and downwardly from the back face portion of such third block member towards the third concave draft load bearing surface. Such third tapered surface area enabling movement of the shank portion of the drawbar in both a vertical angling direction and a horizontal angling direction. Finally, a fifth edge portion is disposed adjacent the back face portion and an outer side face portion of the third block member. This fifth edge portion extends between the upper face portion and the bottom face portion of such third block member.

OBJECTS OF THE INVENTION

It is, therefore, one of the primary objects of the present invention to provide a specially configured insert for use in a rotary end of a drawbar assembly which carries the draft load bearing wear surface and is easily replaceable.

Another object of the present invention is to provide a specially configured draft load bearing insert for use in a rotary end of a drawbar assembly which enables the housing support member to be manufactured from a different and lower cost material if desired.

Still another object of the present invention is to provide a specially configured draft load bearing insert for use in a rotary end of a drawbar assembly which will substantially reduce maintenance cost.

Yet another object of the present invention is to provide a specially configured draft load bearing insert for use in a rotary end of a drawbar assembly which can be used with a number of drawbar support housing designs.

A still further object of the present invention is to provide a specially configured draft load bearing insert for use in a rotary end of a drawbar assembly in which the concave draft load bearing surface can be hardened to increase the wear resistance of such surface.

Still yet another object of the present invention is to provide a specially configured draft load bearing insert for use in a rotary end of a drawbar assembly in which the concave draft load bearing surface will wear more easily than a convex draft load applying surface carried by the rotary end of a drawbar used in the overall assembly.

These and various other objects and advantages of the present invention will become more readily apparent to those persons who are skilled in the railway coupling art from the following more detailed description of the invention, particularly, when such description is taken in conjunction with the attached drawing figures and with the appended claims.

DESCRIPTION OF THE INVENTION

Figure 1:
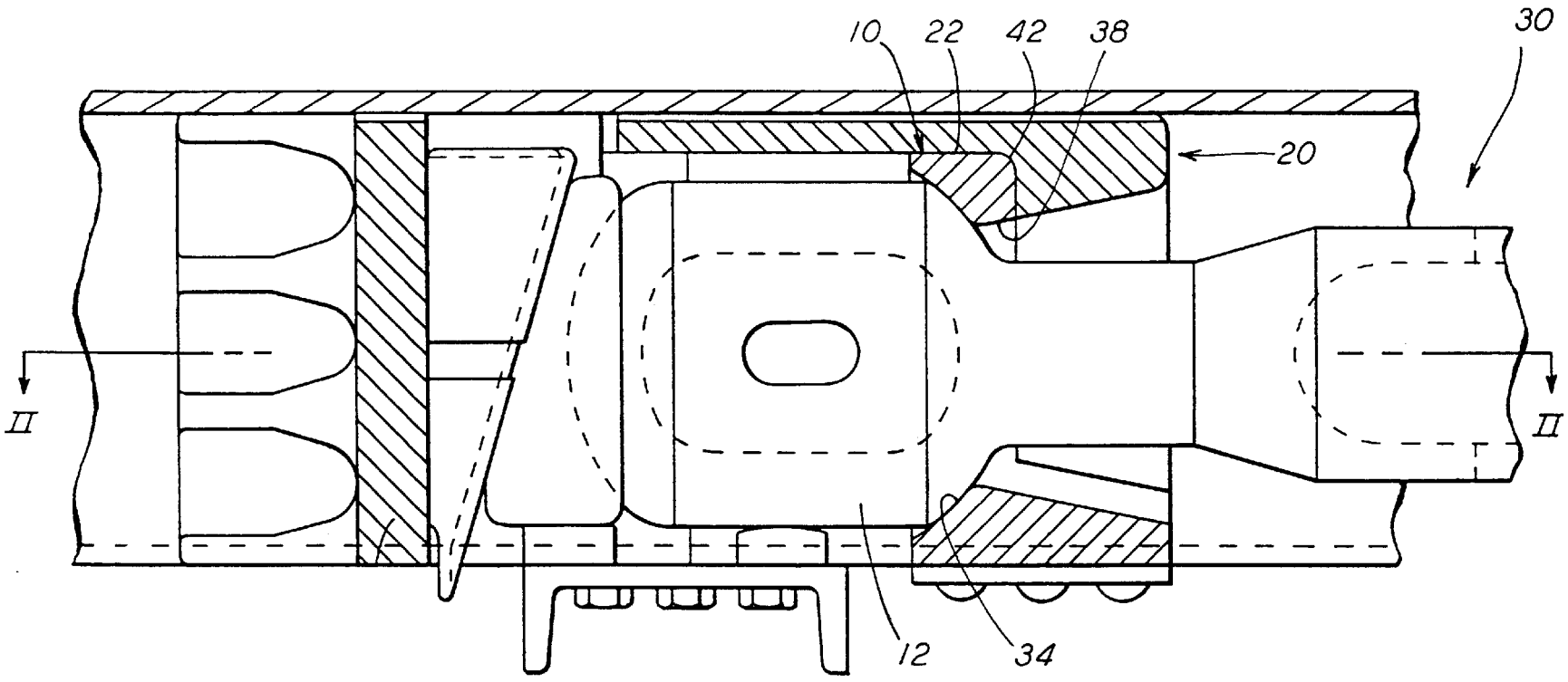
FIG. 1 is a side elevation view, partially in cross-section, showing the insert of the present invention disposed in a housing support member for a rotary end of a drawbar assembly.

Prior to proceeding to the more detailed description of the invention it should be noted that, for the sake of clarity, identical components having identical functions have been identified with identical reference numerals throughout the several views of the drawings.

Figure 2:
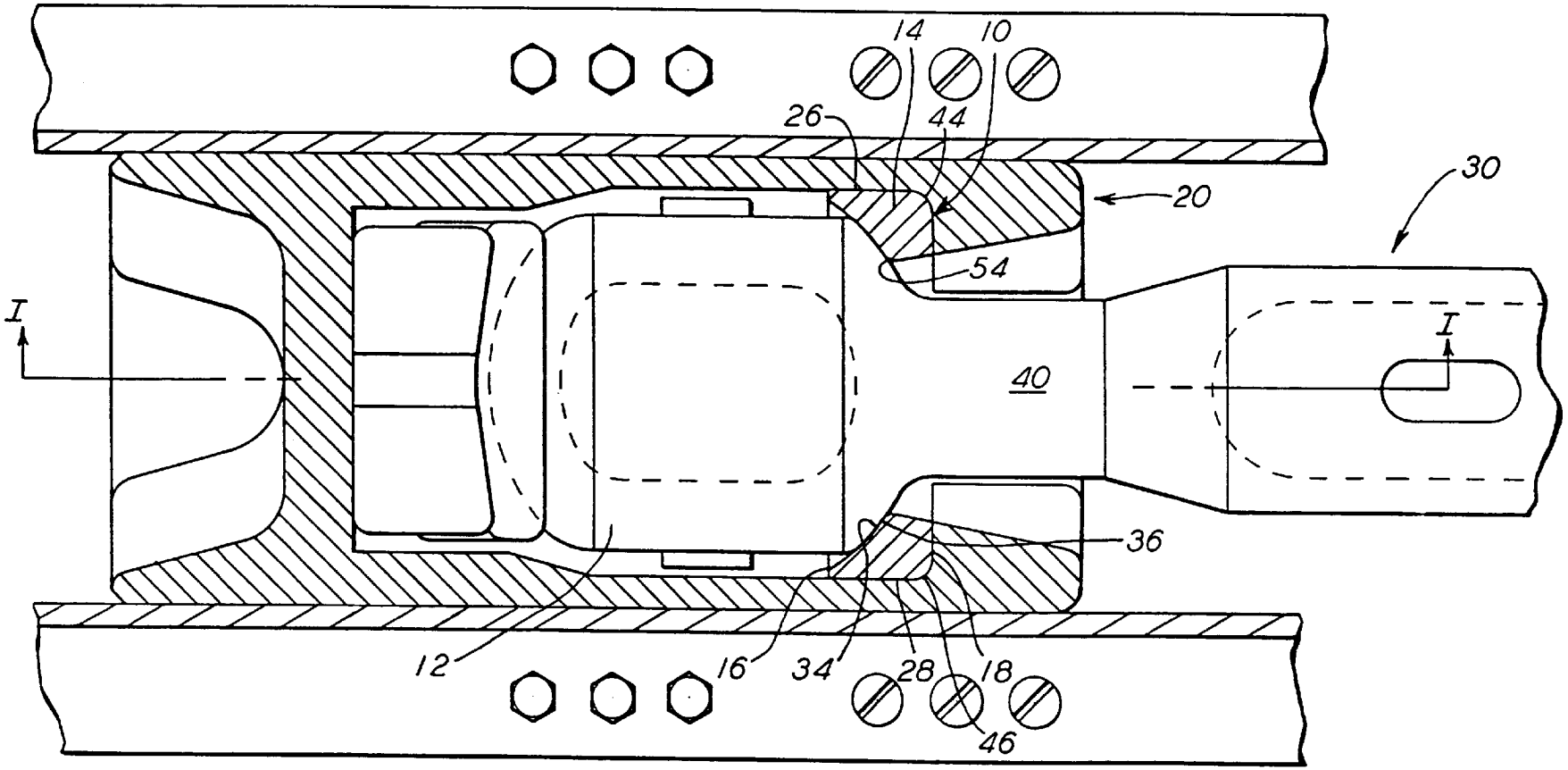
FIG. 2 is a cross-sectional view taken along lines II—II of FIG. 1.
Figure 3:
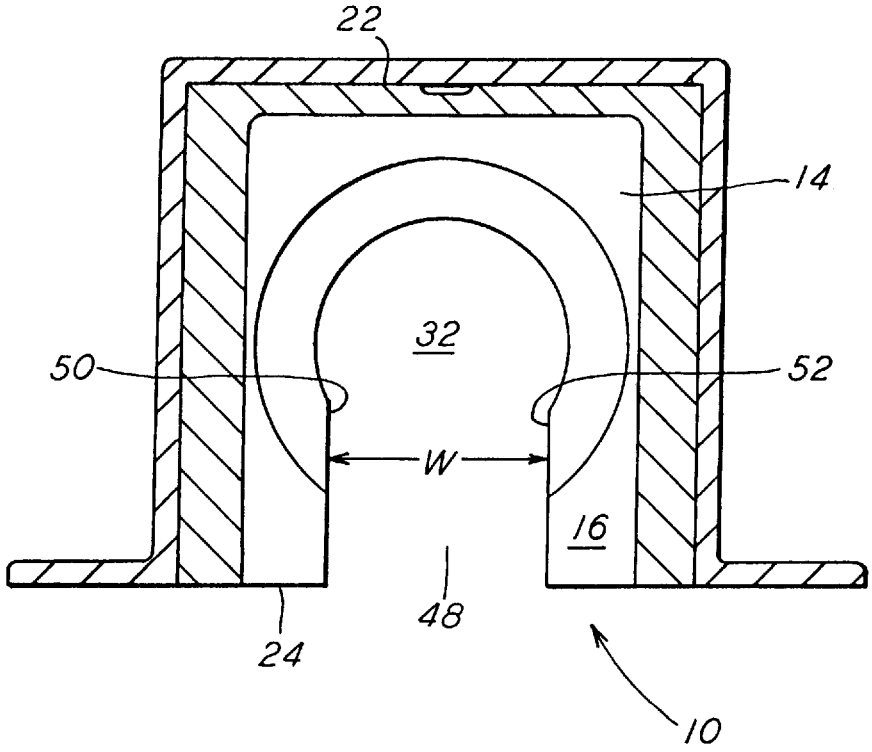
FIG. 3 is a view of the specially configured insert looking at the front face as the insert is installed in the housing support member.

Now refer, more particularly, to FIGS. 1, 2 and 3. Illustrated therein is a specially configured draft load bearing insert, generally designated 10, positioned within a drawbar support housing member, generally designated 20. A rotary drawbar, generally designated 30, having a rotary end portion 12 disposed within the drawbar support housing member 20 is also illustrated.

The specially configured draft load bearing insert 10 accepts draft loads applied thereto from a convex surface carried by the rotary end 12 of the rotary drawbar 30. Draft load bearing insert 10 comprises a generally rectangular block member 14. Block member 14 has each of a predetermined width, a predetermined height, and a predetermined thickness. Block member 14 also has a front face portion 16, a back face portion 18, an upper face portion 22, a bottom face portion 24 and a pair of side face portions 26 and 28. In a presently preferred embodiment of the invention, an outer surface of one of such pair of side face portions 26 and 28 will be disposed substantially parallel to the outer surface of the second one of such pair of side face portions 26 and 28. Alternatively, it may be desirable in certain instances for such pair of side face portions 26 and 28 to be slightly tapered. In this case it is expected that such taper would be inwardly and upwardly from the bottom face portion 24 to the top face portion 22.

At least a portion of an aperture 32 (FIG. 3) is formed through the generally rectangular block member 14. Such aperture 32 extends through such block member 14 from the front face portion 16 to the back face portion 18.

The generally rectangular block member 14 has a concave draft load bearing surface 34 formed in the front face portion 16 thereof. Concave draft load bearing surface 34 is disposed around the aperture 32 for mating engagement with a convex surface area 36 formed on a portion of the rotary end 12 of the rotary drawbar 30. Such convex surface area 36 of the rotary end 12 applies draft loads to the insert 10 by way of the concave draft load bearing surface 34. In a presently preferred embodiment, the concave draft load bearing surface 34 has a predetermined hardness. Hardening of such concave draft load bearing surface 34 increases the wear resistance of insert 10. Further, in the presently preferred embodiment, such concave draft load bearing surface 34 is designed in a manner to wear faster than such convex surface area 36 of the rotary end 12 of the rotary drawbar 30. In this manner the insert 10 becomes a sacrificial member. Obviously, insert 10 is less costly to repair than the rotary drawbar 30.

Tapered surface area 38 is provided on the block member 14 adjacent such at least a portion of the aperture 32. Tapered surface area 38 extends from the back face portion 18 of such block member 14 inwardly toward such concave draft load bearing surface 34. Tapered surface area 38 enables requisite movement of the shank portion 40 of such rotary drawbar 30 in both a vertical angling direction and a horizontal angling direction.

A first edge portion 42, having a first predetermined configuration, is formed on such block member 14 adjacent the upper face portion 22 and the back face portion 18. Such first edge portion 42 extends between the pair of side face portions 26 and 28.

A second edge portion 44, having a second predetermined configuration, is formed on such block member 14 adjacent a first side face portion 26 of such pair of side face portions 26 and 28 and the back face portion 18. This second edge portion 44 extends between the upper face portion 22 and the bottom face portion 24.

There is a third edge portion 46, having a third predetermined configuration, disposed on the block member 14 adjacent a second side face portion 28 of such pair of side face portions 26 and 28 and the back face portion 18. This third edge portion 46, like the second edge portion 44, extends between the upper face portion 22 and the bottom face portion 24 of block member 14.

In the presently preferred embodiment of the invention, the first predetermined configuration of the first edge portion 42 and the second predetermined configuration of such second edge portion 44 and the third predetermined configuration of the third edge portion 46 are substantially identical. Normally, such predetermined configuration will be rounded. However, other configurations may be used for such first, second and third edge portions 42, 44 and 46, such as, a beveled configuration.

The specially configured insert 10, in the presently preferred embodiment of the invention, further includes a generally rectangular cut-out portion 48 (FIG. 3). Cut-out portion 48 has a predetermined width W which extends from the bottom face 24 of such block member 14 to aperture 32 and between such front face portion 16 and the back face portion 18. In the contemplated presently preferred embodiment of the invention, axially opposed side wall faces 50 and 52 of the cut-out portion 48 of such block member 14 will be disposed substantially parallel to one another. On the other hand, these axially opposed side wall faces 50 and 52 of the cut-out portion 48 of block member 14 may be slightly tapered. When such axially opposed side wall faces 50 and 52 are tapered such taper will be upwardly and inwardly from the bottom face portion 24 of such block member 14.

The specially configured insert 10, in the presently preferred embodiment of the invention, further includes an arcuately shaped transition portion 54 which is disposed between the concave draft load bearing surface 34 of block member 14 and the tapered surface area 38 of block member 14.

Figure 4:
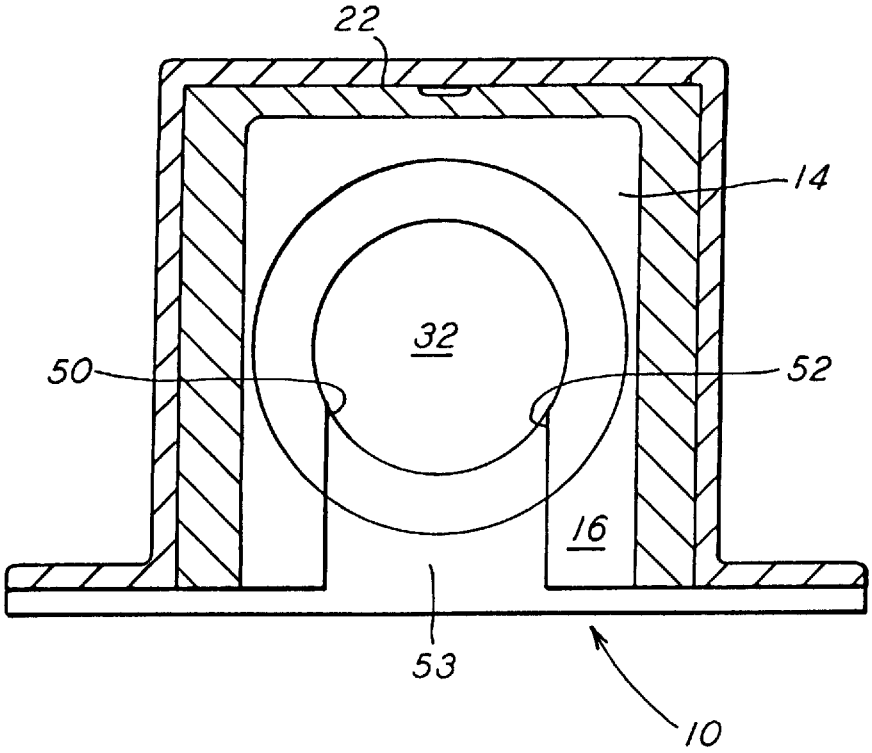
FIG. 4 is a view illustrating a specially configured insert with a support plate disposed in the cut-out portion of such insert.

Disposed between the inner side face portions 50 and 52 of the cut-out portion of the insert 10 is a support plate 54 which carries a concave draft load bearing surface for mating engagement with such convex surface area on the rotary end 12 of the drawbar 30. Support plate 54 is illustrated in FIG. 4.

Figure 5:
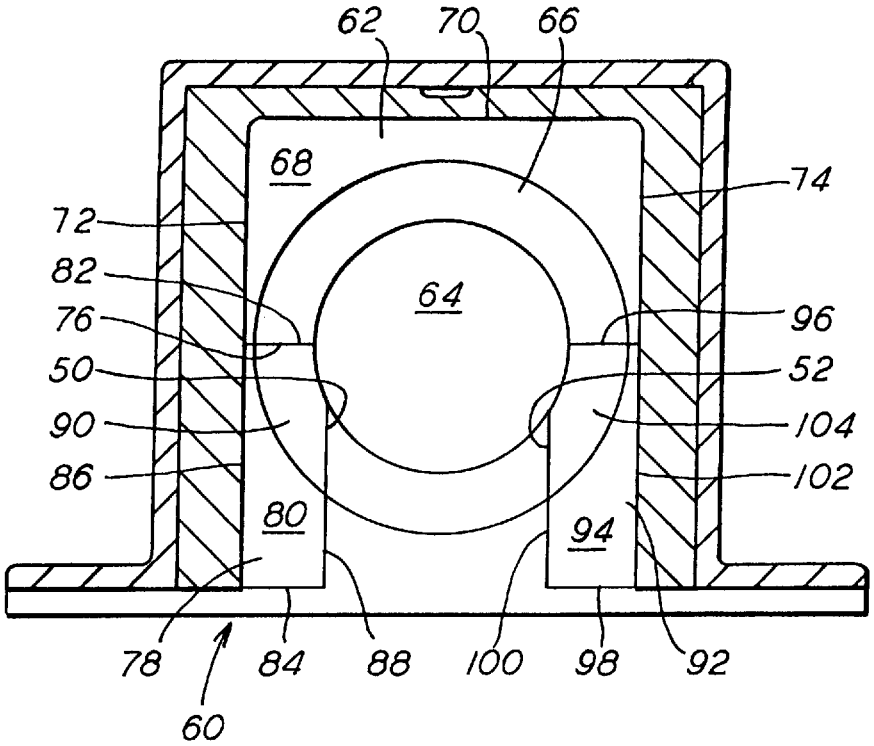
FIG. 5 is an end view of an alternative embodiment of a specially configured insert.

Now refer, more particularly, to FIG. 5. Illustrated therein is an alternative embodiment for a specially configured insert, generally designated 60, for use in the rotary end of a drawbar assembly as a draft block. This embodiment of the specially configured insert 60 includes a first generally rectangular block member 62. Block member 62 has each of a predetermined width, a predetermined height, a predetermined thickness, a front face portion, a back face portion, an upper face portion, a bottom face portion and a pair of side face portions. At least a first portion of an aperture 64 extends through the first block member 62 from the front face portion to the back face portion adjacent the bottom face portion.

A first concave draft load bearing surface 66 is formed in the front face portion 68 around such first portion of the aperture 64. Draft load bearing surface 66 is matingly engageable with at least a first portion of the convex surface area formed on a portion of the rotary end of the drawbar forming a part of the drawbar assembly. As in the embodiment described above, such convex surface area is positioned to apply draft loads to the insert 60.

A first tapered surface area is disposed adjacent such first portion of the aperture 64. Such first tapered surface area extends inwardly toward the aperture 64 and downwardly from the back face portion of the first block member 62 toward the first concave draft load bearing surface 66. Such first tapered surface area is provided to enable movement of a shank portion of such drawbar in both a vertical angling direction and a horizontal angling direction.

First block member 62 has a first edge portion disposed adjacent the upper face portion 70 and the back face portion. Such first edge portion extends between the pair of side face portions 72 and 74. Further, the first edge portion has a first predetermined configuration.

A second edge portion is disposed adjacent a first side face portion 72 of the pair of side face portions 72 and 74 and the back face portion. This second edge portion extends between the upper face portion 70 and the bottom face portion 76 of first block member 62 and has a second predetermined configuration.

Disposed adjacent the second side face portion 74 of such pair of side face portions 72 and 74 and the back face portion is a third edge portion which, like the second edge portion, extends between the upper face portion 70 and the bottom face portion 76 of first block member 62. This third edge portion has a third predetermined configuration.

According to this embodiment of the invention, insert 60 includes a second generally rectangular block member 78 having each of a predetermined width, a predetermined height, a predetermined thickness, a front face portion 80, a back face portion, an upper face portion 82 engageable with bottom face portion 76 of first block member 62, a bottom face portion 84, and a pair of side face portions 86 and 88.

At least a second portion of the aperture 64 extends through the second block member 78 from the front face portion 80 to the back face portion adjacent upper face portion 82. A second concave draft load bearing surface 90 is formed in such front face portion 80 of second block member 78 around the second portion of such aperture 64. The second draft load bearing surface 90 is matingly engageable with at least a second portion of such convex surface area formed on such portion of the rotary end of the drawbar forming a part of the drawbar assembly. Such convex surface area is matingly engageable with the concave surface area of second block member 78 and is positioned to apply draft loads to the insert 60.

A second tapered surface area is disposed adjacent the second portion of aperture 64 in the second block member 78. The second tapered surface area extends inwardly toward the aperture 64 and downwardly from the back face portion of the second block member 78 toward the second concave draft load bearing surface 90 to enable movement of the shank portion of the drawbar in both a vertical angling direction and a horizontal angling direction.

Second block member 78 includes a fourth edge portion disposed adjacent the back face portion and the outer side face portion 86. Such fourth edge portion extending between the upper face portion 82 and the bottom face portion 84 of second block member 78. Preferably, the fourth edge portion will have a configuration substantially identical to the second edge portion of the first block member 62.

In this embodiment of the invention, insert 60 further includes a third generally rectangular block member 92 having each of a predetermined width, a predetermined height, a predetermined thickness, a front face portion 94, a back face portion, an upper face portion 96 engageable with the bottom face portion 76 of first block member 62, a bottom face portion 98 and a pair of side face portions 100 and 102. At least a third portion of the aperture 64 extends through a third block member 92 from such front face portion 94 to the back face portion adjacent the upper face portion 96 and the inner side face portion 100.

A third concave draft load bearing surface 104 is formed in the front face portion 94 of such third block member 92 around the third portion of such aperture 64. Such third concave draft load bearing surface 104 matingly engages with at least a third portion of such convex surface area formed on such portion of the rotary end of the drawbar which is in a position to apply draft loads to the insert 60.

A third tapered surface area is disposed adjacent such third portion of the aperture 64 in the third block member 92.

Such third tapered surface area extends inwardly towards the aperture 64 and downwardly from the back face portion of third block member 92 towards such draft load bearing surface 104 to enable movement of the shank portion of the drawbar in both a vertical angling direction and a horizontal angling direction. A fifth edge portion is disposed adjacent the back face portion and the outer side face portion 102 of such pair of side face portions 100 and 102. Such fifth edge portion extends between the upper face portion 96 and the bottom face portion 98 of third block member 92. In the presently preferred embodiment, the fifth edge portion will have a predetermined configuration substantially identical to the configuration of the third edge portion of first block member 62. Also, it is presently preferred that such second block member 78 will be substantially a mirror image of the third block member 92.

In this alternative embodiment, it is also presently preferred that the second block member 78 and the third block member 92 will further include an arcuately shaped transition portion disposed adjacent a respective portion of such aperture and between respective portions of such concave draft load bearing surface 66, 90 and 104 and the tapered surface area.

It is also presently preferred, in this embodiment of the invention, that the insert 60 will further include an interlocking means in which a first portion is disposed on the bottom face portion 76 of the first block member 62. A second portion of the interlocking means is disposed on the upper face portion 82 of the second block member 78 and a third portion of such interlocking means is disposed on the upper face portion 96 of the third block member. Such interlocking means enables securing the block member 78 and the third block member 92 to such first second block member 62.

It is also presently preferred that the inner side face portion 88 of the second block member 78 will be disposed substantially parallel to the inner side face portion 100 of such third block member 92.

Figure 6:
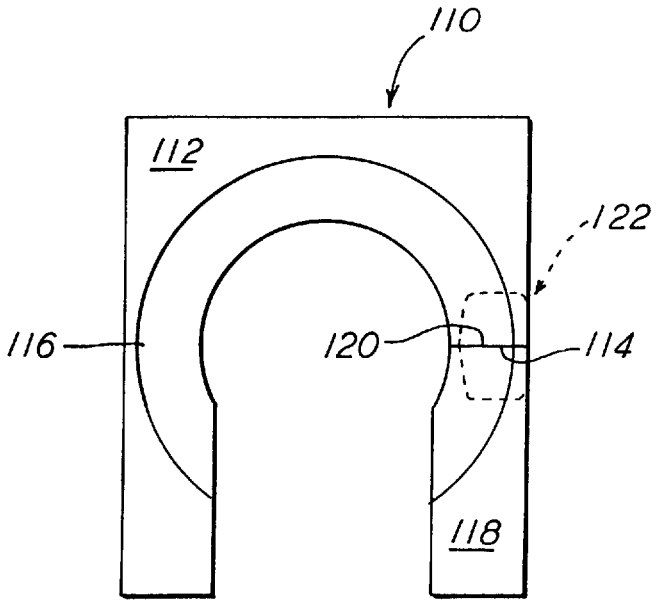
FIG. 6 is an end view showing still another embodiment of a specially configured insert.

Reference is now made to FIG. 6. Illustrated therein is an elevational view of another alternative embodiment for a specially configured two-piece insert for use in the rotary end of a drawbar assembly support housing as a draft block. In this embodiment, such specially configured insert, generally designated 110, includes a first block member 112 having each of a predetermined configuration, a predetermined thickness, a front face portion, a back face portion and a bottom face portion 114. The predetermined configuration of first block member 112 will preferably be semi-circular. At least a first portion of an aperture is disposed adjacent the bottom face portion 114 and extending through the first block member 112 from the front face portion to the back face portion.

A first concave draft load bearing surface 116 is formed in the front face portion around such first portion of the aperture for mating engagement with the first portion of a convex surface area formed on a portion of the rotary end of the drawbar forming a part of the drawbar assembly. Such convex surface are is disposed in a position to apply draft loads to the insert.

A first tapered surface area is disposed adjacent such first portion of the aperture. This first tapered surface area extends inwardly toward the aperture and downwardly from the back face portion of the first block member 112 toward the first concave draft load bearing surface 116 to enable movement of a shank portion of such drawbar in both a vertical angling direction and a horizontal angling direction.

In this embodiment, the insert 110 includes a second block member 118 having each of a predetermined configuration, a predetermined thickness, a front face portion, a back face portion, an upper face portion 120 for engagement with the bottom face portion 114 of the first block member 112. Preferably, such second block member 118 will be generally rectangular in shape.

A second portion of the aperture is disposed adjacent the upper face portion 120 in the second block member 118 and extends through such second block member 118 from the front face portion to the back face portion. A second concave draft load bearing surface is formed in the front face portion around the second portion of the aperture for mating engagement with a second portion of the convex surface area formed on a portion of the rotary end of the drawbar.

A second tapered surface area is disposed adjacent the second portion of the aperture and extends inwardly toward such aperture and downwardly from the back face portion of the second block member 118 toward the second concave draft load bearing surface which enables movement of the shank portion of the drawbar in both a vertical and horizontal angling direction.

While a number of presently preferred and alternative embodiments of the present invention have been described in detail above, it should be understood that those persons who are skilled in the coupling art may make various other modifications and adaptations of the invention without departing from the spirit or scope of the appended claims.

I claim:

1. A specially configured insert for use in a rotary end of a drawbar assembly as a draft block, said specially configured insert comprising:

(a) a generally rectangular block member having each of a predetermined width, a predetermined height, a predetermined thickness, a front face portion, a back face portion, an upper face portion, a bottom face portion and a pair of side face portions;

(b) at least a portion of an aperture extending through said block member from said front face portion to said back face portion;

(c) a concave draft load bearing surface formed in said front face portion around said at least a portion of said aperture for mating engagement with at least a first portion of a convex surface area formed on a portion of such rotary end of a drawbar of such drawbar assembly, such convex surface area being in a position to apply draft loads to said insert;

(d) a tapered surface area adjacent said at least a portion of said aperture which extends inwardly toward said aperture and downwardly from said back face portion of said block member toward said concave draft load bearing surface to enable movement of a shank portion of such drawbar in both a vertical angling direction and a horizontal angling direction;

(e) a first edge portion disposed adjacent said upper face portion and said back face portion, said first edge portion extending between said pair of side face portions, said first edge portion having a first predetermined configuration;

(f) a second edge portion disposed adjacent a first one of said pair of side face portions and said back face portion, said second edge portion extending between said upper face portion and said bottom face portion, said second edge portion having a second predetermined configuration;

(g) a third edge portion disposed adjacent a second of said pair of side face portions and said back face portion, said third edge portion extending between said upper face portion and said bottom face portion, said third edge portion having a third predetermined configuration and (h) a generally rectangular cut-out portion, having a predetermined width, which extends from said bottom face portion of said block member to said aperture and between said front face and said back face.

2. A specially configured insert, according to claim 1, wherein said insert further includes an arcuately shaped transition portion disposed adjacent said aperture and between said concave draft load bearing surface and said tapered surface area.

3. A specially configured insert, according to claim 1, wherein said first predetermined configuration of said first edge portion and said second predetermined configuration of said second edge portion and said third predetermined configuration of said third edge portion are substantially identical.

4. A specially configured insert, according to claim 3, wherein said predetermined configuration of each of said first and said second and said third edge portion is rounded.

5. A specially configured insert, according to claim 3, wherein said predetermined configuration of each of said first and said second and said third edge portion is beveled.

6. A specially configured insert, according to claim 1, wherein said concave draft load bearing surface is hardened to increase wear resistance.

7. A specially configured insert, according to claim 1, wherein said concave draft load bearing surface is designed to wear faster than such convex surface area on such portion of such rotary end of such drawbar in said mating engagement therewith.

8. A specially configured insert, according to claim 1, wherein axially opposed side wall faces of said cut-out portion of said block member are substantially parallel to one another.

9. A specially configured insert, according to claim 1, wherein axially opposed side wall faces of said cut-out portion of said block member are slightly tapered upwardly and inwardly from said bottom face portion of said block member.

10. A specially configured insert, according to claim 1, wherein an outer surface of a first of said pair of side face portions is substantially parallel to an outer surface of a second of said pair of side face portions.

11. A specially configured insert, according to claim 1, wherein said pair of side wall portions are slightly tapered inwardly and upwardly from said bottom face portion to said top face portion.

12. A specially configured insert for use in a rotary end of a drawbar assembly as a draft block, said specially configured insert comprising:

(a) a first block member having each of a predetermined configuration, a predetermined thickness, a front face portion, a back face portion and a cut-out portion defining a bottom face portion;

(b) at least a first portion of an aperture disposed adjacent said bottom face portion and extending through said first block member from said front face portion to said back face portion;

(c) a first concave draft load bearing surface formed in said front face portion around said at least a first portion of said aperture for mating engagement with at least a first portion of a convex surface area formed on a portion of such rotary end of a drawbar of such drawbar assembly, such convex surface area being in a position to apply draft loads to said insert;

(d) a first tapered surface area disposed adjacent said at least a first portion of said aperture which extends inwardly toward said aperture and downwardly from said back face portion of said first block member toward said first concave draft load bearing surface to enable movement of a shank portion of such drawbar in both a vertical angling direction and a horizontal angling direction;

(e) a second block member having each of a predetermined configuration, a predetermined thickness, a front face portion, a back face portion and an upper face portion for engagement with said bottom face portion of said first block member to provide the missing said cut-out portion;

(f) at least a second portion of said aperture disposed adjacent said upper face portion and extending through said second block member from said front face portion to said back face portion;

(g) a second concave draft load bearing surface formed in said front face portion around said at least a second portion of said aperture for mating engagement with at least a second portion of such convex surface area formed on such portion of such rotary end of such drawbar in such position to apply draft loads to said insert; and (h) a second tapered surface area disposed adjacent said at least a second portion of said aperture which extends inwardly toward said aperture and downwardly from said back face portion of said second block member toward said second concave draft load bearing surface to enable movement of such shank portion of such drawbar in both said vertical angling direction and said horizontal angling direction.

13. A specially configured insert, according to claim 12, wherein said predetermined configuration of at least one of said first block member and said second block member is generally rectangular.

14. A specially configured insert for use in a rotary end of a drawbar assembly as a draft block, said specially configured insert comprising:

(a) a first generally rectangular block member having each of a predetermined width, a predetermined height, a predetermined thickness, a front face portion, a back face portion, an upper face portion, a bottom face portions a pair of side face portions, and a cut-out portion;

(b) at least a first portion of an aperture extending through said first block member from said front face portion to said back face portion;

(c) a first concave draft load bearing surface formed in said front face portion around said at least a first portion of said aperture for mating engagement with at least a first portion of a convex surface area formed on a portion of such rotary end of a drawbar of such drawbar assembly, such convex surface area being in a position to apply draft loads to said insert;

(d) a first tapered surface area disposed adjacent said at least a first portion of said aperture which extends inwardly toward said aperture and downwardly from said back face portion of said first block member toward said first concave draft load bearing surface to enable movement of a shank portion of such drawbar in both a vertical angling direction and a horizontal angling direction;

(e) a first edge portion disposed adjacent said upper face portion and said back face portion, said first edge portion extending between said pair of side face portions, said first edge portion having a first predetermined configuration;

(f) a second edge portion disposed adjacent a first one of said pair of side face portions and said back face portion, said second edge portion extending between said upper face portion and said bottom face portion, said second edge portion having a second predetermined configuration;

(g) a third edge portion disposed adjacent a second of said pair of side face portions and said back face portion, said third edge portion extending between said upper face portion and said bottom face portion, said third edge portion having a third predetermined configuration;

(h) a second generally rectangular block member having each of a predetermined width, a predetermined height, a predetermined thickness, a front face portion, a back face portion, and an upper face portion engageable with said bottom face portion of said first block member to provide the missing said cut-out portion;

(i) at least a second portion of said aperture extending through said second block member from said front face portion to said back face portion adjacent said upper face portion and an inner side face portion;

(j) a second concave draft load bearing surface formed in said front face portion of said second block member around said second portion of said aperture for mating engagement with at least a second portion of such convex surface area formed on such portion of such rotary end of a drawbar of such drawbar assembly in a position to apply draft loads to said insert;

(k) a second tapered surface area adjacent said at least a second portion of said aperture in said second block member which extends inwardly towards said aperture and downwardly from said back face portion of said second block member towards said second concave draft load bearing surface to enable movement of a shank portion of such drawbar in both a vertical angling direction and a horizontal angling direction;

(l) a fourth edge portion disposed adjacent said back face portion and an outer side face portion, said fourth edge portion extending between said upper face portion and said bottom face portion of said second block member;

(m) a third generally rectangular block member having each of a predetermined width, a predetermined height, a predetermined thickness, a front face portion, a back face portion, an upper face portion engageable with said bottom face portion of said first block member, a bottom face portion and a pair of side face portions;

(n) at least a third portion of said aperture extending through said third block member from said front face portion to said back face portion adjacent said upper face portion and an inner side face portion;

(o) a third concave draft load bearing surface formed in said front face portion of said third block member around said third portion of said aperture for mating engagement with at least a third portion of such convex surface area formed on such portion of such rotary end of a drawbar of such drawbar assembly in a position to apply draft loads to said insert;

(p) a third tapered surface area adjacent said at least a third portion of said aperture in said third block member which extends inwardly towards said aperture and downwardly from said back face portion of said third block member toward said third concave draft load bearing surface to enable movement of a shank portion of such drawbar in both a vertical angling direction and a horizontal angling direction; and (q) a fifth edge portion disposed adjacent said back face portion and an outer side face portion, said fifth edge portion extending between said upper face portion and said bottom face portion of said third block member.

15. A specially configured insert, according to claim 14, wherein said second block member is substantially a mirror image of said third block member.

16. A specially configured insert, according to claim 14, wherein each of said first block member, said second block member and said third block member further include an arcuately shaped transition portion disposed adjacent a respective portion of said aperture and between respective portions of said concave draft load bearing surface and said tapered surface area.

* * * * *